US010442588B2

(12) United States Patent
Bischoff et al.

(10) Patent No.: US 10,442,588 B2
(45) Date of Patent: Oct. 15, 2019

(54) CONTAINER FOR FABRIC TREATMENT COMPOSITION

(71) Applicant: WHIRLPOOL CORPORATION, Benton Harbor, MI (US)

(72) Inventors: Corey Michael Bischoff, Cincinnati, OH (US); Benjamin Janes Beck, Boston, MA (US)

(73) Assignee: Whirlpool Corporation, Benton Harbor, MI (US)

( * ) Notice: Subject to any disclaimer, the term of this patent is extended or adjusted under 35 U.S.C. 154(b) by 259 days.

(21) Appl. No.: 15/446,551

(22) Filed: Mar. 1, 2017

(65) Prior Publication Data

US 2017/0259967 A1 Sep. 14, 2017

Related U.S. Application Data

(63) Continuation of application No. 13/930,196, filed on Jun. 28, 2013, now abandoned.

(51) Int. Cl.

| | |
|---|---|
| ***B65D 25/14*** | (2006.01) |
| ***B65D 51/00*** | (2006.01) |
| ***B67D 7/84*** | (2010.01) |
| ***B65D 77/20*** | (2006.01) |
| ***D06F 58/20*** | (2006.01) |
| ***B65D 6/00*** | (2006.01) |

(52) U.S. Cl.

CPC ..... *B65D 51/002* (2013.01); *B65D 11/20* (2013.01); *B65D 25/14* (2013.01); *B65D 77/2024* (2013.01); *B67D 7/84* (2013.01); *D06F 58/203* (2013.01); *B65D 2221/00* (2013.01); *B65D 2231/005* (2013.01)

(58) Field of Classification Search

CPC .. B65D 51/002; B65D 25/14; B65D 2221/00; D06F 58/203; B67D 7/84

USPC ..... 220/524.4, 608; 206/524.4

See application file for complete search history.

(56) References Cited

U.S. PATENT DOCUMENTS

| | | | |
|---|---|---|---|
| 3,464,832 | A | 9/1969 | Mullinix |
| 4,285,468 | A | 8/1981 | Hyman |
| 4,311,250 | A | 1/1982 | Ravve et al. |
| 5,176,314 | A | 1/1993 | Akazawa et al. |
| 6,073,772 | A | 6/2000 | Forbes et al. |
| 6,439,387 | B1 | 8/2002 | Bergman |
| 7,891,515 | B2 | 2/2011 | Bourgoin et al. |
| 2003/0152501 | A1 | 8/2003 | Byrd et al. |
| 2003/0183548 | A1 | 10/2003 | Oertel |
| 2005/0048233 | A1 | 3/2005 | Nomula |
| 2006/0243630 | A1 | 11/2006 | Bourgoin et al. |

(Continued)

*Primary Examiner* — Stephen J Castellano

(74) *Attorney, Agent, or Firm* — Price Heneveld LLP

(57) ABSTRACT

A container for a fabric treatment composition having: (a) a container floor extending to a floor boundary, a portion of the container floor being a collection zone, and a raised portion extending inwardly within the container, at least a portion of the collection zone being located on a longitudinal axis of the container and at least a portion of the raised portion intersecting the longitudinal axis and transverse axis of the container; (b) a peripheral wall extending from the container floor; (c) a peripheral flange extending from the peripheral wall; and (d) a needle piercable membrane sealed to the peripheral flange to define an interior volume, wherein the interior volume contains less than about 100 mL of a liquid fabric treatment composition.

15 Claims, 9 Drawing Sheets

(56) References Cited

U.S. PATENT DOCUMENTS

| | | | | |
|---|---|---|---|---|
| 2006/0260973 | A1 | 11/2006 | Macinnes et al. | |
| 2007/0151877 | A1 | 7/2007 | Newman | |
| 2007/0292643 | A1* | 12/2007 | Renn ..... | B65D 25/14<br>428/35.7 |
| 2008/0073239 | A1 | 3/2008 | Duffield et al. | |
| 2011/0065556 | A1 | 3/2011 | Middleton et al. | |
| 2011/0147260 | A1 | 6/2011 | Perchtold et al. | |
| 2013/0256237 | A1 | 10/2013 | Wang et al. | |
| 2014/0069927 | A1 | 3/2014 | Willemsen | |

* cited by examiner

CONTAINER FOR FABRIC TREATMENT COMPOSITION

CROSS-REFERENCE TO RELATED APPLICATION

This application is a continuation of and claims priority to U.S. patent application Ser. No. 13/930,196, filed on Jun. 28, 2013, entitled "CONTAINER FOR FABRIC TREATMENT COMPOSITION," now abandoned, the entire disclosure of which is hereby incorporated herein by reference.

FIELD OF THE INVENTION

Container for fabric treatment composition.

BACKGROUND OF THE INVENTION

As the members of a typical household have become busier and busier, the amount of time that persons have to devote to laundering clothing has decreased. The decrease in time available for doing the laundry has unfortunately not been accompanied by a decrease in the number of clothing articles worn by a typical person in a fixed period of time, for example, a week. With the advent of specialized clothing articles for different activities, for example cycling, golf, yoga, aerobics, zumba, kickboxing, martial arts, and running, the number of clothing articles worn by a person in a week has increased. Thus, consumers are interested in ways to quickly refresh clothing that is not heavily soiled or malodorous, without having to pass the article of clothing through a laundry washing machine and dryer. Further, consumers are interested in ways to avoid subjecting expensive clothing to the rough conditions found in a washing machine.

Current ways to quickly refresh clothing are thought to be able to reduce odors and wrinkles in previously worn clothing articles. For instance, fabric refreshing cabinets that apply steam or a mist of water to one or more garments contained therein and then dry the garments within the cabinet have been developed. Although these devices are described to provide freshening and dewrinkling benefits, it has been found that the devices do not provide sufficiently crisp appearance and feel within a limited amount of time and energy use.

Steam based devices for treating fabrics typically heat a volume of water to boiling point, thereby generating steam. Heating the water to boiling point requires a considerable amount of energy and heat. Further, the heating device used by the apparatus requires a certain amount of time to reach the temperature required to heat the water to boiling temperature. Typically, the device does not activate the heating element until the user inserts clothing and turns the device on. This process typically takes a long time to run and complete the treatment cycle. Consumers have been found to desire the treatment to be completed in a short amount of time such that the fabrics can be treated within the amount of time it would typically take a consumer to conduct his or her hygiene and beauty routines.

Another type of fabric treating device is one that distributes fluids, such as water and/or chemical compositions, onto the fabrics by misting within the device or distributing the fluid directly onto the fabrics through ultrasonic nebulizers. In a typical embodiment, a device is provided that has a large reservoir to hold a volume of chemical composition sufficient to treat multiple garments over many uses.

Providing the consumer the opportunity to store a large volume of chemical composition with the device can be practical since the consumer will have to open the reservoir on the device, for instance by disengaging a threaded cap, then open the container that was purchased in a store, and then pour the chemical composition from the container purchased from the store, and then reclose the reservoir on the device, and then reclose or dispose of the container that was purchased from the store. It is thought that by providing a reservoir that can contain a large volume of chemical composition it is convenient to the user since she will only infrequently need to add chemical composition to the device.

One problem with the approach of providing a large reservoir with the device is that the user has little flexibility to choose different chemical compositions for different articles of clothing. For instance, the chemical composition that performs best when dewrinkling or crisping a wool suit may be quite different from a chemical composition that is particularly designed for athletic wear due to the nature of the different types of fibers found in each article of clothing.

Another problem with the approach of providing a large reservoir with the device is that the user has little flexibility to choose different scents for different articles of clothing or even the same type of clothing. It is thought that by repeated exposure to a particular scent, the person smelling such scent can become desensitized to such scent and derive little pleasure from retrieving a refreshed garment from the device and wearing the article. Further, different scents may be desired for different circumstances, for example a business day or an evening social engagement.

With these limitations in mind, there is a continuing unaddressed need for a single use container for a fabric treatment composition that can be individually inserted into a fabric refreshing device to dose the fabric treatment composition.

SUMMARY OF THE INVENTION

A container for a fabric treatment composition comprising: (a) a container floor extending to a floor boundary, a portion of said container floor being a collection zone, and a raised portion extending inwardly within said container, at least a portion of said collection zone being located on a longitudinal axis of said container and at least a portion of said raised portion intersecting said longitudinal axis and transverse axis of said container; (b) a peripheral wall extending from said container floor; (c) a peripheral flange extending from said peripheral wall; and (d) a needle piercable membrane sealed to said peripheral flange to define an interior volume, wherein said interior volume contains less than about 100 mL of a liquid fabric treatment composition.

DETAILED DESCRIPTION OF THE INVENTION

Figure 1:
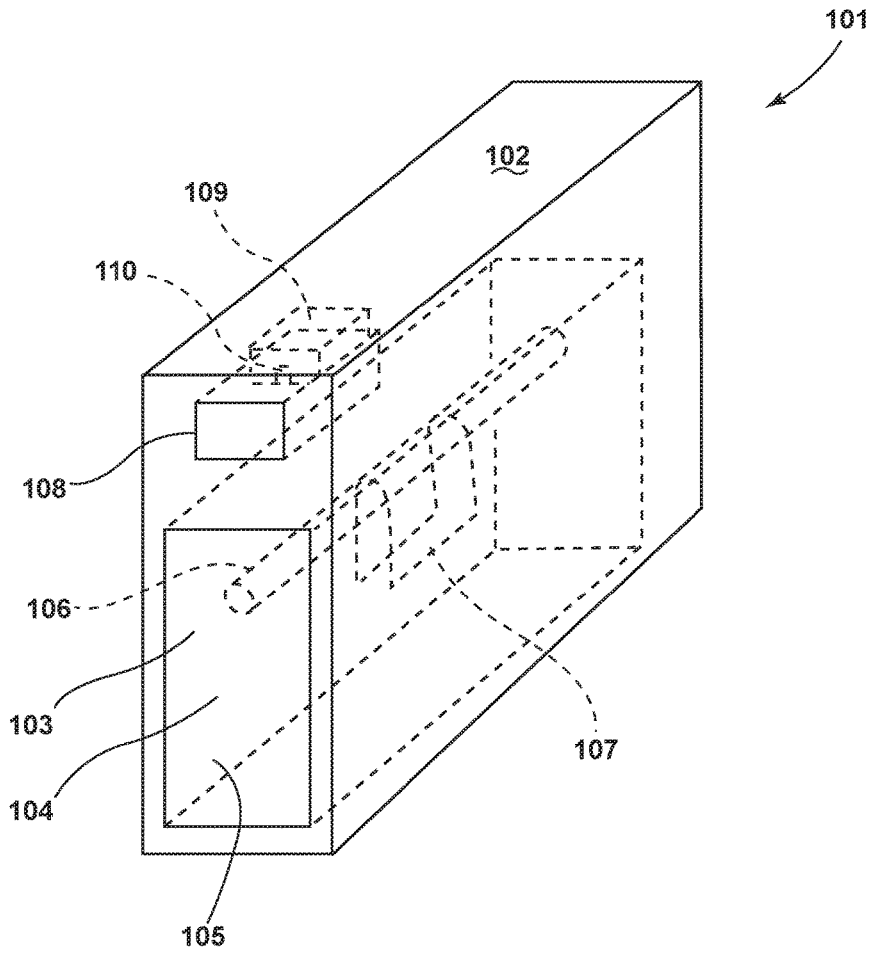
FIG. 1 is a schematic of a fabric refreshing cabinet device.

Single use containers for containing a fabric treatment composition are practical for use in a variety of fabric refreshing cabinet devices 101. A schematic of a fabric refreshing cabinet device 101 is shown in FIG. 1. A fabric refreshing cabinet can comprise: a shell 102 which may be in the form of a non-collapsing cabinet comprising an opening; and an extractable pull-out drawer 103 comprising: a drawer face 104 comprising an outer surface 105; a supporting member 106 such as a rod, pole, beam, hooks or other member capable of suspending a fabric 107 or a fabric hung upon a fabric hanging member such as a hanger, wherein the drawer face 104 and the supporting member 106 form a receiving region adapted to operably support a fabric 107, and wherein the extractable pull-out drawer 103 is adapted to fit within the shell 102; a heating element contained within the device; and an air flow path positioned to direct air through the receiving region 111 containing the support member 106. The extractable pull-out drawer 103 can be slideably engaged with the shell 102. As used herein, fabrics include one or more items of clothing, garments, textiles, towels, table cloths, drapes, chair covers, and the like.

In one non-limiting embodiment, the fabric refreshing device 101 can comprise a footprint that is compact in width such that the device can be used in a bedroom, closet or other living space where larger wider devices are inconvenient. A small footprint for a present fabric refreshing device 101 can be achieved using an extractable pull-out drawer 103 design. An extractable pull-out drawer 103 can be preferred over a hinged door since an extractable pull-out drawer 103 can require less space than a hinged door.

The side portions of the shell can comprise one or more dispensing heads (including but not limited to sprayer heads, hydraulic nozzles, sonic or ultrasonic nebulizers, pressure swirl atomizers, high pressure fog nozzle, and combinations thereof) positioned at a desired distance from any fabrics contained within the device.

Since space in a consumer's home is often at a premium, it is desirable for the fabric refreshing cabinet 101 to be small. The container for containing a fabric treatment composition disclosed herein can be an important aspect for making a small fabric refreshing cabinet device 101. For instance, if the fabric refreshing cabinet device 101 is provided with a large reservoir for containing fabric treatment composition, the fabric refreshing cabinet device must include space for such a large reservoir. A small compact container for containing a fabric treatment composition will take up less space in the fabric refreshing cabinet device than a large reservoir. At a minimum, the container for containing a fabric treatment composition can contain a volume of liquid fabric treatment composition sufficient for a single run cycle of the fabric refreshing cabinet device.

As shown in FIG. 1, the fabric refreshing cabinet device 101 can have a port 108 sized and dimensioned for receiving a container for a fabric treatment composition. An extraction device 109 can be provided with the fabric refreshing cabinet device 101 for extracting liquid fabric treatment composition from the container for a fabric treatment composition. The extraction device 109 can comprise a moveable cannula 110 having suction applied there to that penetrates the container and extracts the liquid fabric treatment composition from the container. The extraction device 109 can transport the liquid fabric treatment composition downstream to the location from which the liquid fabric treatment composition is applied to the fabric 107. For instance the extraction device 109 can dispense the fabric treatment composition through nozzles that are aimed at the fabric 107 being treated.

Figure 2:
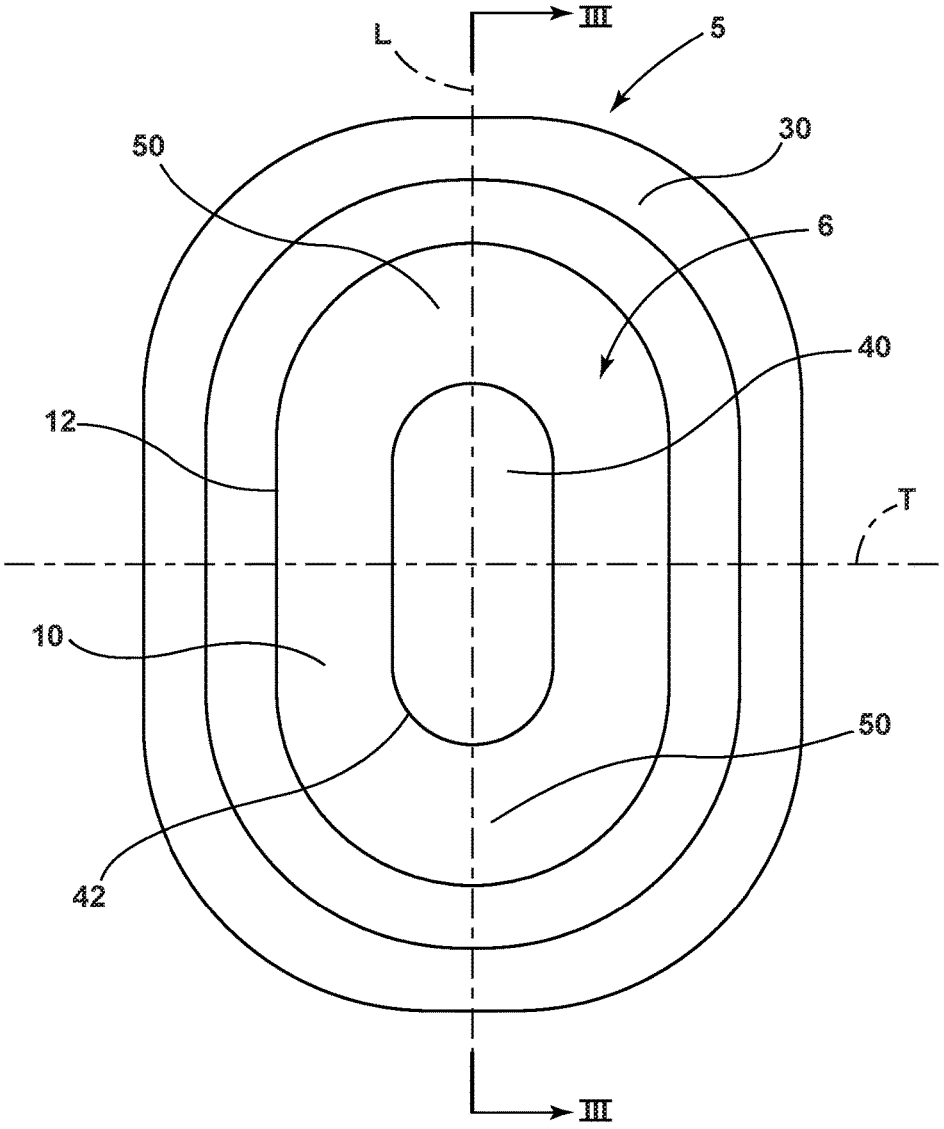
FIG. 2 is a top view of a container devoid of a needle piercable membrane.

A top view of a container 5 is shown in FIG. 2. The container 5 can be sized and dimensioned to be receivable by a port 108 in a fabric refreshing cabinet device 101. The container 5 can have a container floor 10 extending to a floor boundary 12. The container floor 10 can be the base of container 5 or a portion of the container 5 upon which the container 5 can rest when placed on a flat surface. The floor boundary 12 can define the edge of the container floor 10 outward and upward from which the peripheral wall 20 extends.

The container floor 10 can have a collection zone 50 and a raised portion 40 extending inwardly within the container 5. The collection zone 50 can be a location in the container floor 10 from which the liquid fabric treatment composition can be extracted. The collection zone 50 can be a sump, low spot, or zone that is part of the container floor 10 and within the container 5 into which liquid fabric treatment composition drains to or flows towards as the liquid fabric treatment composition is extracted from the container 5. The collection zone 50 can positioned such that it is at least as deep as all other locations of the container floor 10 with depth being measured from the surface defined by the interior boundary of the peripheral flange 30. The raised portion 40 can have a raised portion periphery 42 that defines the boundary of the raised portion 40 or the boundary between the raised portion 40 and container floor 10. The container 5 can have an interior volume 6.

The raised portion 50 can have a volume of more than about 0.5 mL, alternatively more than about 0.8 mL, alternatively more than about 1.0 mL, inclusive of the constituent material of the raised portion, the container floor oriented towards the interior of the container 5 being the datum.

The container 5 can have longitudinal axis L and a transverse axis T, the transverse axis T being orthogonal to the longitudinal axis L. The collection zone 50 can be located such that at least a portion of the collection zone 50 is located on a longitudinal axis L of the container 5. It can be desirable to have at least a portion of the collection zone 50 located on the longitudinal axis L so that if the liquid fabric treatment composition is extracted near or close to the container floor boundary 12, a cannula puncturing the needle piercable membrane does not tip the container about an axis parallel to the longitudinal axis or off-axis from the longitudinal axis. It can also be desirable to have at least two collection zones 50 located opposite to one another on opposing sides of the raised portion 40. Such an arrangement can permit the consumer to insert the container 5 into the port 108 in at least two orientations in which liquid fabric treatment composition can be extracted from the container 5.

The container 5 can extend along the longitudinal axis L between about 60 mm and about 200 mm, alternatively between about 90 mm and about 120 mm, or even about 95 mm. The container 5 can extend along the transverse axis T between about 20 mm and about 100 mm, alternatively between about 50 mm and about 70 mm, or alternatively about 67 mm.

Figure 3:
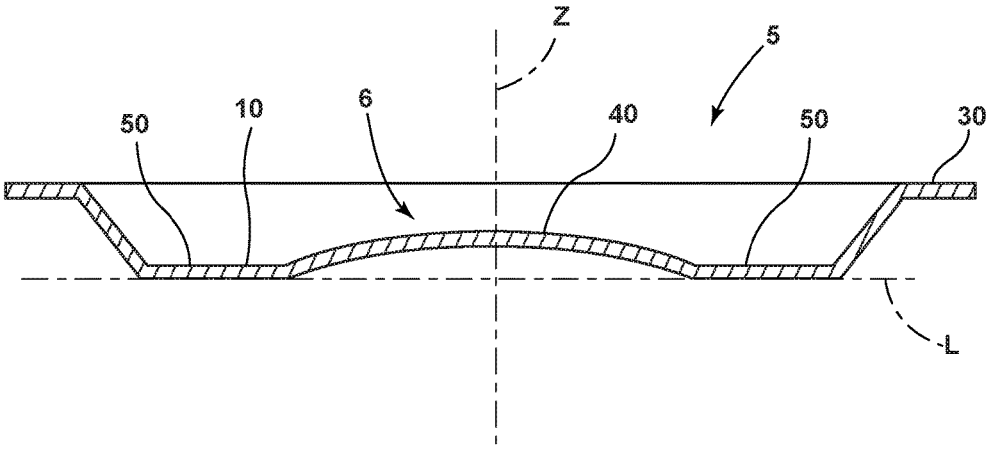
FIG. 3 is a cross section of the container shown in FIG. 2, the cross section taken along 3-3' as indicated in FIG. 2.

A cross-section of the portion of the container 5 rendered in FIG. 2 is shown in FIG. 3. As shown in FIG. 3, the container 5 can have a vertical axis Z extending orthogonal to the longitudinal axis L and transverse axis T.

The container 5 can have a raised portion 40. The raised portion 40 can provide for enhanced extraction capability from the container in that fluid on the raised portion 40 can tend to flow towards the collection zone 50. Further, the raised portion 40 can provide for positive nesting with a bed or hump in the port 108 of the fabric refreshing cabinet device 101. For instance the port 108 may have a contoured raised surface that is a positive surface and the raised portion 40 defines a negative surface of the exterior of the container 5 into which the raised surface nests. This arrangement can provide for enhanced stability of the container 5 with respect to the port 108 when the needle piercable membrane is pierced. Further, the raised portion 40 can be desirable from a container 5 processing view point. For example, by having the raised portion 40, the containers 5 can be stacked compactly and relatively securely after they are manufactured and before filling with liquid fabric treatment composition.

The raised portion 40 can be a rounded, prism shaped (having facets), a combination of rounded and prism shaped parts, or any three-dimensional surface profile. The raised portion 40 can be surrounded by the container floor 12 so that the container floor 12 is effectively the bottom of a channel defined by the raised portion 40, the container floor 12, and the peripheral wall 20 that can convey liquid fabric treatment composition around the raised portion 40.

The raised portion 40 is also thought to provide a benefit in that the gradient in the surface of the raised portion 40 can reduce the amount of fabric treatment composition retained on the interior surface of the container 5 when used. Without being bound by theory, it is thought that if the container 5 had a relatively flat container floor 10, more of the fabric treatment composition might be retained within the container 5 due to surface tension of the fabric treatment composition to the container 5 and the lack of a total head difference when the flow is along a flat surface. The slope of the raised portion 40 can be set to be high enough so that the surface tension between the fabric treatment composition and the container 5 is insufficient to retain the fabric treatment on such a sloped surface.

The raised portion 40 can extend along the longitudinal axis L by about 25 mm to about 125 mm, alternatively by about 30 mm to about 70 mm. The raised portion 40 can extend along the transverse axis T between about 5 mm to about 50 mm, alternatively between about 15 mm and about 25 mm. The raised portion 40 can extend inwardly within the container 5 in a direction aligned with the vertical axis Z.

The peripheral wall 20 extends from the container floor 10. The peripheral wall 20 serves to provide depth to the container 5. From a practical viewpoint, the container floor 10 and raised portion 40 can form the bottom of the container 5 and the peripheral wall 20 can define the walls of the container to form the container 5. The peripheral wall 20 can extend between the floor boundary 12 and the peripheral flange 30. The peripheral wall 20 can intercept the floor boundary 12 at an angle of about 45 degrees. The peripheral wall 20 can comprise one or more cylindrical sections. The peripheral wall 20 can comprise one or more frusto-conical sections.

The peripheral wall 20 can extend between about 12 mm and about 50 mm, alternatively between about 20 mm and about 30 mm, or even about 27 mm, in the direction measured orthogonal to the longitudinal axis L and the transverse axis T.

A peripheral flange 30 can extend from the peripheral wall 20. The peripheral flange 30 can provide a surface to which the needle piercable membrane can be sealed. The peripheral flange 30 can be, by way of non-limiting example a flat surface or a contoured surface. The peripheral flange 30 need only have a sufficient surface area to bond the needle piercable membrane to the peripheral flange 30 so that the needle piercable membrane can remain sealed to the peripheral flange 30 during packaging, shipping, storage, display, transport to the consumer's home, storage in the home, and handling in the home.

The peripheral flange 30 can extend outwardly from the peripheral wall 20 by between about 2 mm and about 15 mm, alternatively about 5 mm to about 10 mm, alternatively about 9 mm. The peripheral flange 30 can extend outwardly from the peripheral wall 20 by more than about 1 mm, by more than about 3 mm, and alternatively by more than about 5 mm.

The peripheral flange 30 can be a flat surface. The peripheral flange can be shaped such that when the container 5 is resting on a flat surface, such as a table or shelf, with the container floor 10 oriented towards the surface the peripheral flange 30 is parallel to the surface.

Figure 4:
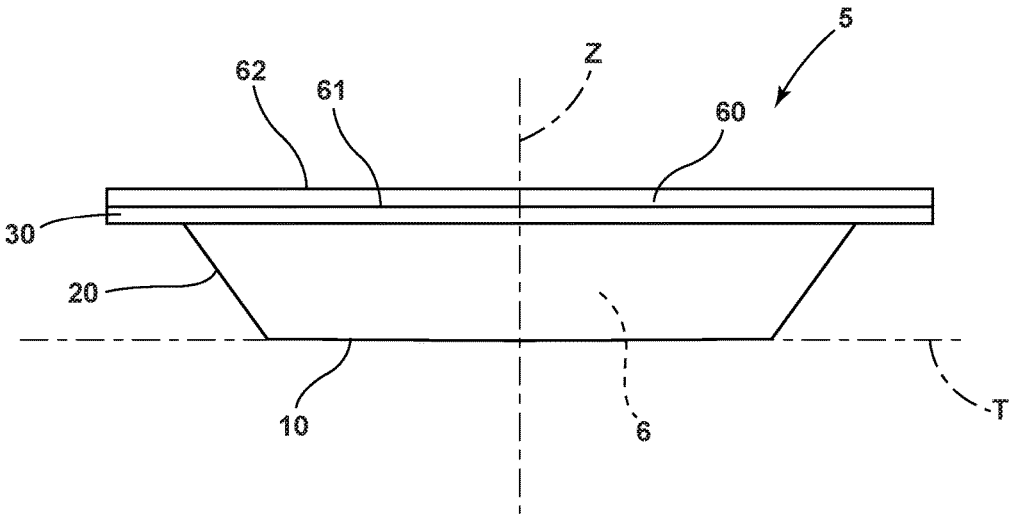
FIG. 4 is side view of a container.
Figure 5:
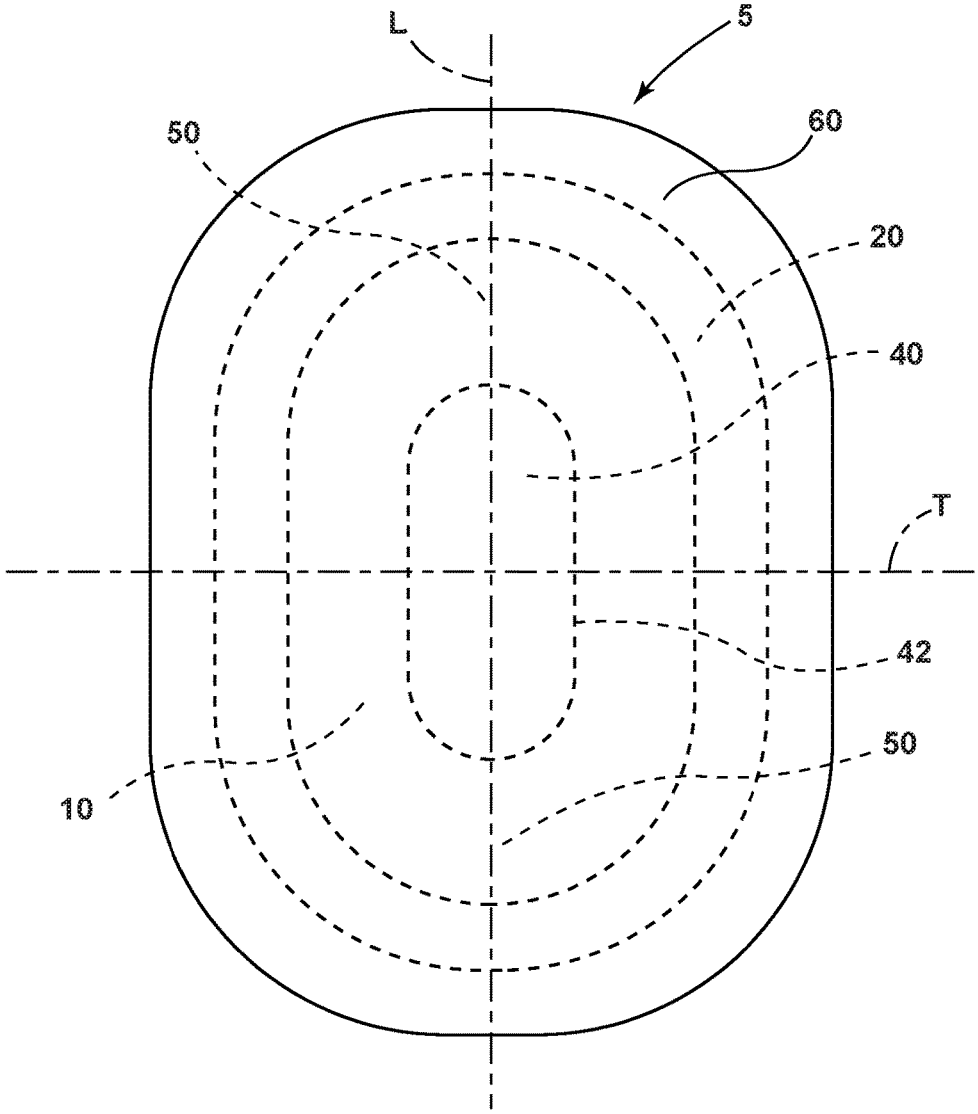
FIG. 5 is a top view of a container.

A needle piercable membrane 60 can be sealed to the peripheral flange 30 to define an interior volume 6, as shown in FIG. 4. The needle piercable membrane 60 can have an inner surface 61 oriented towards the container floor 10 and an outer surface 62 oriented away from the container floor 10. The interior volume 6 can contain less than about 100 mL of liquid fabric treatment composition. The interior volume 6 can be between about 20 mL and about 200 mL, alternatively between about 50 mL and about 100 mL, alternatively between about 60 mL and about 80 mL. A top view of the container 5 shown in FIG. 4 is shown in FIG. 5.

The container 5 can comprise a material selected from the group consisting of polyethylene terephthalate, polypropylene, high impact polystyrene, polyethylene, high density polyethylene, polyvinyl chloride, and combinations thereof. The container floor 10, peripheral wall 20, and peripheral flange 30, can be comprised of such previously mentioned materials and can comprise monolayers or laminates of such materials and each element can be comprised of the same material and or structure or each element can comprise a different material and or structure. The container floor 10, wall 20, and peripheral flange 30 can have a thickness less than about 1 mm.

The needle piercable membrane 60 can a laminate material. The needle piercable membrane 60 can comprise a layer of 40# paper and 0.35 mil thick foil bonded to one another with a coextruded layer of #7 polyethylene to bond the paper and foil layers. The needle piercable membrane 60 can be formed by extrusion lamination. The needle piercable membrane 60 can be adhesion laminated to the peripheral flange 30 of the container with using an adhesive. The adhesive can be chemically compatible with the fabric treatment composition and have sufficient peel strength so that the needle piercable membrane cannot be easily removed from the container 5 or cannot be removed from the container 5 without destroying the needle piercable membrane 60.

Figure 6:
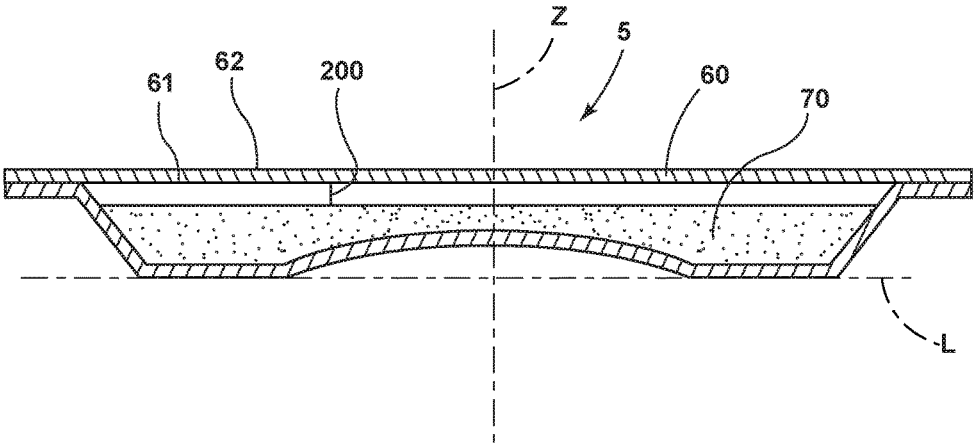
FIG. 6 is a side cross sectional view of a container.

A cross section of a container 5 containing fabric treatment composition 70 is shown in FIG. 6. As shown in FIG. 6, head space 200 can be provided between the fabric treatment composition 70 and the needle piercable membrane 60. The head space 200 can be measured as the distance between the inner surface 61 of the needle piercable membrane 60 and the fabric treatment composition 70. A least about 2 mm of head space 200 can be provided. At least about 4 mm of head space 200 can be provided. At least about 6 mm of head space 200 can be provided. Providing head space 200 in this manner is thought to be practical in that it can help to avoid splashing during filling of the container 5 on a manufacturing line. Further, providing head space 200 can help to accommodate the effects of temperature change on the fabric treatment composition 70, air in the head space 200, and off gassing that might occur from the fabric treatment composition 70.

As shown in FIG. 2, the raised portion 40 can be symmetric about one or both of the longitudinal axis L and transverse axis T. For instance the raised portion 40 can have a raised portion periphery 42 that is a circle, oval, rectangle, square, or other shape.

Figure 7:
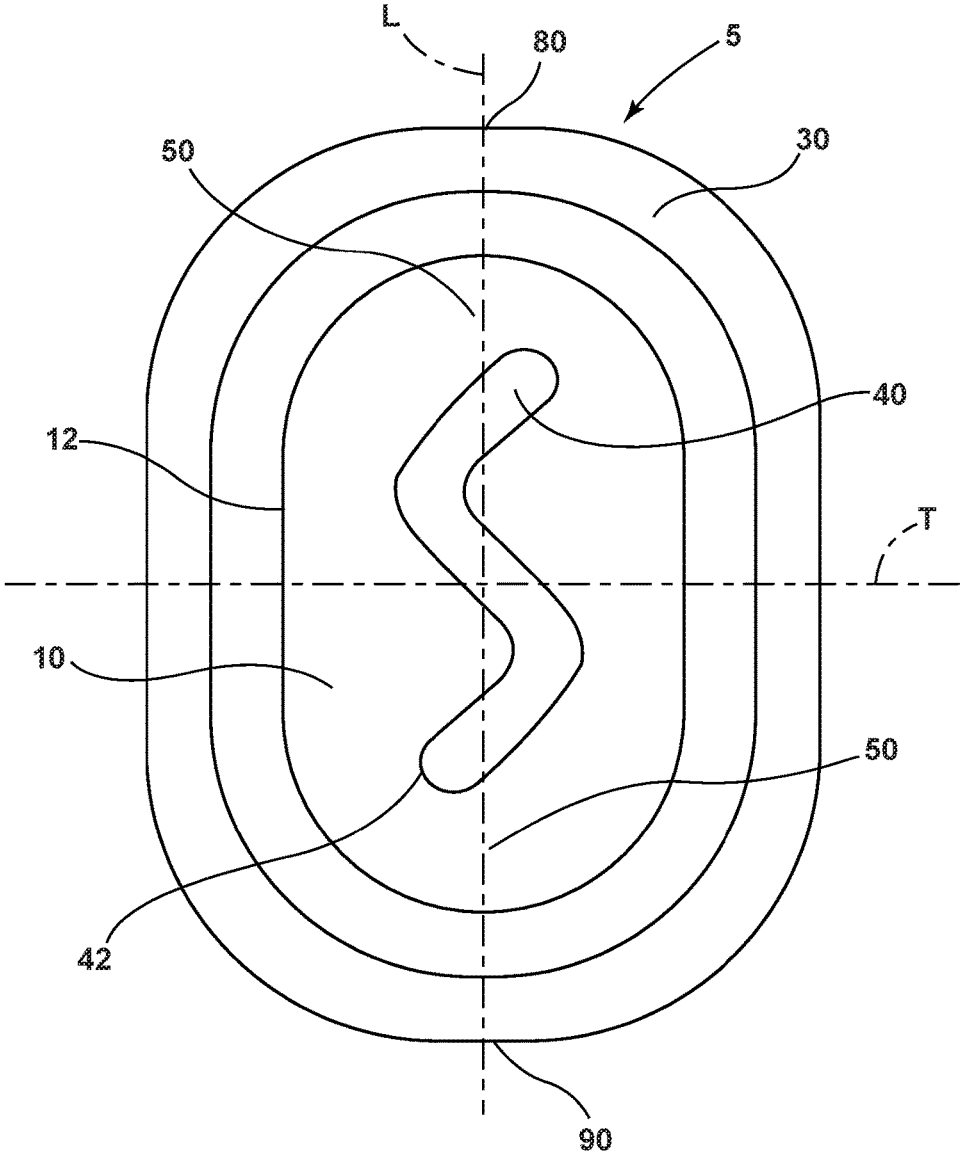
FIG. 7 is a top view of a container devoid of a needle piercable membrane.

The raised portion 40 can be a shape when viewed orthogonal to the plane defined by the longitudinal axis L and transverse axis T that has rotational symmetry of order two. The order of rotational symmetry is the number of times that a shape matches upon itself as it is rotated one full rotation, not counting its starting position but counting its finishing position. An example of a container 5 having a raised portion 40 having a shape that has a rotational symmetry of order two is shown in FIG. 7. Examples of shapes having rotational symmetry of order two include S or a reverse-S shapes, backslash (/), and forward slash (\) shapes. By providing a raised portion 40 having a shape that has rotational symmetry of order two, if the container is inserted into a port 108 that has a contoured raised surface to which the container 5 can nest, such container can be inserted into the port with either the first end 80 or second end 90 inserted first yet still be securely fitted in place with the surface within the port 108 to which the container 5 nests. This arrangement can provide for enhanced stability of the container 5 with respect to the port 108 when the needle piercable membrane is pierced and act as a signal to the consumer that she has installed the container 5 into the port 108 correctly and securely. Further, the raised portion 40 can be desirable from a container 5 processing view point. For example, by having the raised portion 40, the containers 5 can be stacked compactly and relatively securely after they are manufactured and before filling with liquid fabric treatment composition 70. Further, the raised portion 40 can provide a shell structure for the base of the container 5 to impart bending stiffness to the container 5. Further, the raised portion 40 can reduce the effects of warping on the ability for the container 5 to sit stably on a flat surface.

Figure 8:
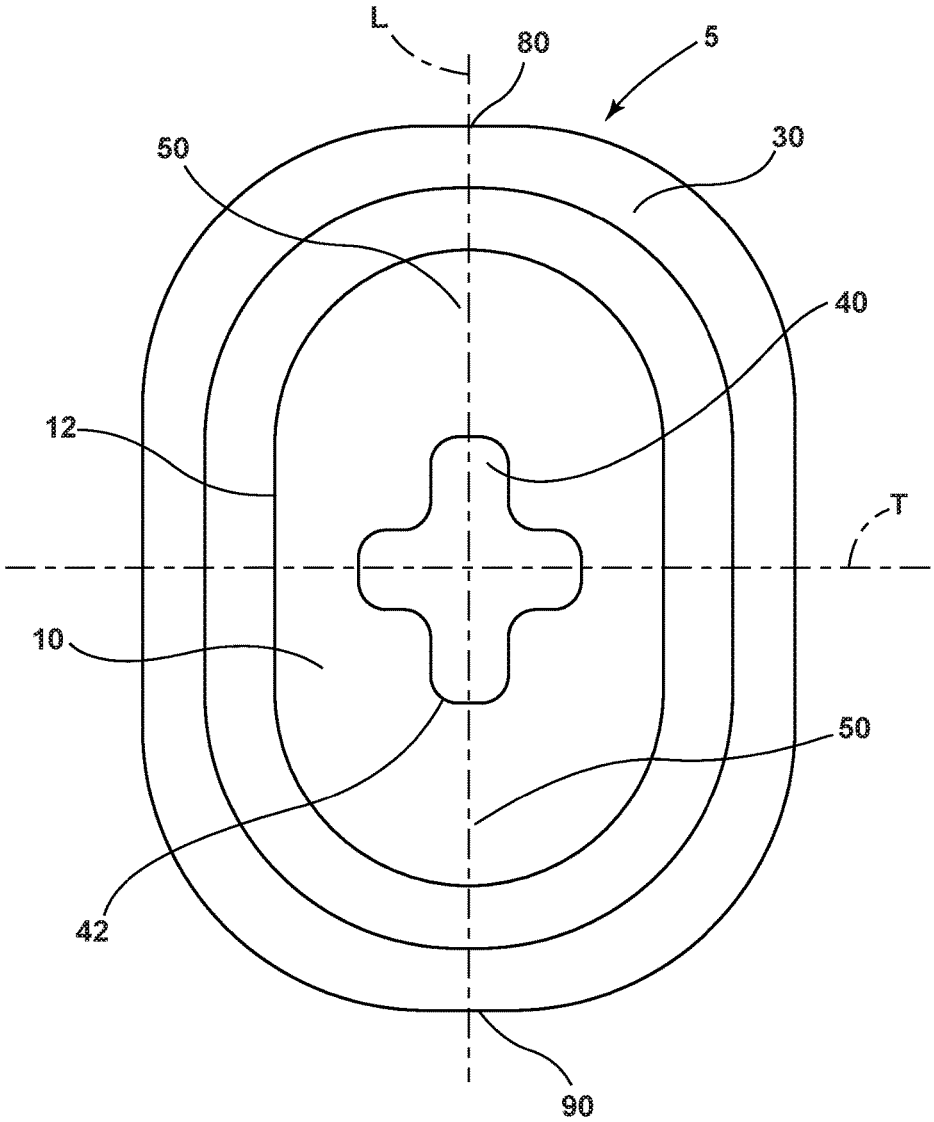
FIG. 8 is a top view of a container devoid of a needle piercable membrane.
Figure 9A:
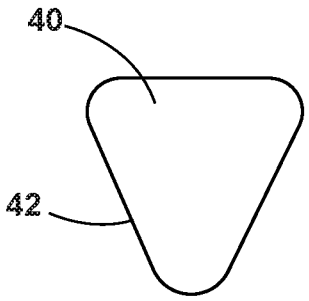
FIG. 9A is a top view of a non-limiting example of a raised portion.
Figure 9D:
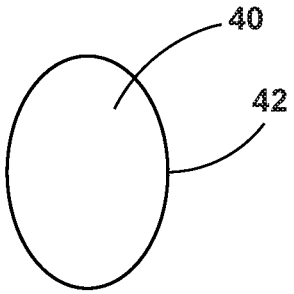
FIG. 9D is another top view of a non-limiting example of a raised portion.
Figure 9B:
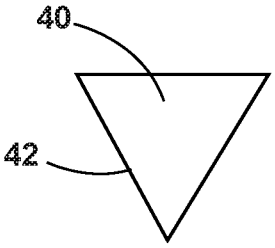
FIG. 9B is another top view of a non-limiting example of a raised portion.
Figure 9E:
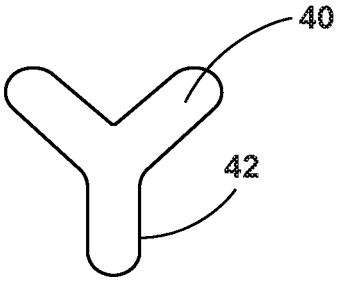
FIG. 9E is another top view of a non-limiting example of a raised portion.
Figure 9C:
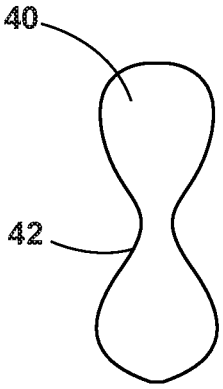
FIG. 9C is another top view of a non-limiting example of a raised portion.

Optionally, the raised portion 50 can be a shape having rotational symmetry of order four, as shown in FIG. 8. Other shapes are contemplated for the raised portion 40 including, but not limited to, those shown in FIGS. 9A-9E, of which embodiments B and E have rotational symmetry of order three. Shapes having a rotational symmetry of order include three include y-shaped and equilateral triangle shapes, and other equilateral three sided shapes. The raised portion 50 can be a shape having rotational symmetry of order 3 or more.

The components of the container 5 other than that needle piercable membrane 60 can be formed form polypropylene and optionally include one or both of calcium carbonate and carbon black. The components of the container 5 other than that needle piercable membrane 60 can be hydrophobic. The container floor, the raised portion, and the peripheral wall can comprise a hydrophobic substrate. The container floor 10, the raised portion 40, the peripheral wall 20, and the peripheral flange 30 can comprise a hydrophobic substrate. The substrate can be a polyolefin, biosourced polymer, or other material, by way of non-limiting examples. The substrate can be polypropylene having a weight fraction of calcium carbonate, and optionally include carbon black. Fabric treatment compositions 70 having a high weight fraction of water, for example more than about 95% by weight, alternatively more than about 97% by weight, alternatively more than about 98% by weight, are thought to have a sufficiently low contact angle with polypropylene such that little of the fabric treatment composition 70 is retained on the surface of the container 5 when the fabric treatment composition 70 is extracted from the container 5. One or more or all of the container floor 10, peripheral wall 20, and the peripheral flange 30 can comprise a thermoset or thermoplastic polymer.

The fabric treatment composition 70 can have a contact angle with at least one of the container floor 10 and peripheral wall 20 that is less than about 90 degrees, alternatively less than about 70 degrees, alternatively less than about 60 degrees, alternatively less than about 50 degrees, alternatively less than about 40 degrees, alternatively less than about 35 degrees. The fabric treatment composition 70 can have a contact angle with the container floor 10, the peripheral wall 20, or both the container floor 10 and peripheral wall 20 that is less than about 90 degrees, alternatively less than about 70 degrees, alternatively less than about 60 degrees, alternatively less than about 50 degrees, alternatively less than about 40 degrees, alternatively less than about 35 degrees.

In use, the fabric treatment composition 70 can be extracted by cannula 110 that is positioned such that the open end of the cannula 110 is placed proximal the container floor 10. The open end of the cannula 100 can be positioned such that it is within less than about 2 mm, or alternatively less than about 1 mm, the container floor 10. Without being bound by theory, it is thought container floor 10 and/or container peripheral wall (20) can comprise a material such that the fabric treatment composition 70 does not bead up when in contact with such parts of the container 5. It is thought that a greater degree of extraction from the container 5 can be obtained when the fabric treatment composition 70 being extracted wets the material forming the container and the extraction is being conducted proximal the container floor 10. This is opposite what one skilled in the art might expect if the fabric treatment composition 70 were being dispensed via pouring from the container 5, in which beads of fluid might roll off the surface of the container 5 and provide for more complete pouring. A liquid can be considered to wet a surface, as opposed to bead up, if such liquid has a contact angle with the surface less than about 90 degrees.

The fabric treatment composition 70 can comprise a water soluble quaternary ammonium surfactant (quat). Typically, minimum levels of the water soluble quat included in the compositions of the present invention are at least about 0.01%, alternatively at least about 0.05%, alternatively at least about 0.1%, alternatively at least about 0.2% by weight, based on the total weight of the composition. Typically maximum levels of water soluble quaternary agent included in the composition are up to about 20%, alternatively less than about 10%, and alternatively less than about 3% based on the total weight of the composition. Typically, the agent is present in the composition in an amount of about 0.2% to about 1.0%.

Specifically, the water soluble quaternary compounds can be dialkly quaternary surfactant compounds. Suitable quaternary surfactants include, but are not limited to, quaternary ammonium surfactants having the formula:

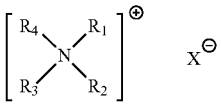

wherein R 1 and R2 are individually selected from the group consisting of C1-C4 alkyl, C1-C4 hydroxy alkyl, benzyl, and —(C2H40)xH where x has a value from about 2 to about 5; X is an anion; and (1) R3 and R4 are each a C6-C14 alkyl or (2) R3 is a C6-C13 alkyl, and R4 is selected from the group consisting of C1-C10 alkyl, C1-C10 hydroxy alkyl, benzyl, and —(C2H40)xH where x has a value from 2 to 5. The asymmetric quaternary compounds can be compounds where R3 and R4 are not identical, and optionally one is branched and the other one is linear.

An example of a suitable asymmetric quaternary compound is ARQUAD HTL8-MS where X is a methyl sulfate ion, RI and R2 are methyl groups, R3 is a hydrogenated tallow group with <5% mono unsaturation, and R4 is a 2-ethylhexyl group. ARQUAD HTL8-MS is available from Akzo Nobel Chemical of Arnhem, Netherlands.

An example of a suitable symmetric quaternary compound is UNIQUAT 22c50 where X is a carbonate and bicarbonate, R I and R2 are methyl groups, R3 and R4 are CIO alkyl groups. UNIQUAT 22c50 is a registered trademark of Lonza and in North America is available thru Lonza Incorporated of Allendale, NewJersey.

Another example of a suitable water soluble quaternary compound is BARQUAT CME-35 which is N-Cetyl Ethyl Morpholinium Ethosulfate available from Lonza and having the following structure:

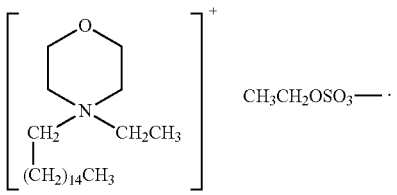

The fabric treatment composition 70 can have an oil component. The oil component can be a substantially water insoluble material that is incorporated into the fabric treatment composition 70 by way of a microemulsion. Typically the minimum levels of the oil component included in the fabric treatment composition 70 are at least about 0.001%, alternatively at least about 0.005%, alternatively at least about 0.01%, and typically maximum levels of oil components are up to about 5%, alternatively less than about 3%, alternatively less than about 1.5%; with typical levels being in the range of about 0.05% to about 1%. The oil component can be a single component, but is typically a mixture and usually represents the incorporation of some benefit agent into the fabric treatment composition 70. Typically the oil component is a perfume made up a mixture of components, but can also be non-perfume materials such as substituted or unsubstituted hydrocarbons and the like. For a sprayable fabric treatment composition 70, the oil component or mix can be a liquid at room temperature for ease of incorporation into the fabric treatment composition 70 and less potential for nozzle clogging on drying.

The oil components of the fabric treatment composition 70 can be substantially water insoluble and form a microemulsion. Substantially water insoluble means the clogP of the ingredients are greater than about 1. A clogP of about 1 indicates that the component would tend to partition into octanol about 10 times more than water. Components in the oil mixture can be branched hydrocarbons and perfumes when perfumes are used.

The fabric treatment composition 70 can comprise perfume. The fabric treatment compositions 70 described herein can also provide a "scent signal" in the form of a pleasant odor which provides a freshness impression to the treated fabrics. The scent signal can be designed to provide a fleeting or longer lasting perfume scent. When perfume is added as a scent signal, it is added only at very low levels, e.g., from about 0.001% to about 0.01% by weight of the usage of the fabric treatment composition 70.

When higher levels of fabric freshness are preferred, relatively higher levels of perfume can be added. These levels may be minimally from about 0.005%, alternatively at least about 0.01%, alternatively at least about 0.1%, and typically maximum levels of up to about 5%, alternatively less than about 3%, and alternatively less than about 1%, each of the percentages being by weight of the fabric treatment composition 70.

Any type of perfume can be incorporated into the fabric treatment composition 70 of the present invention. The perfume ingredients can be those suitable for use for application on fabrics and garments.

When long lasting fragrance odor on fabrics may desired, it is possible to use at least an effective amount of perfume ingredients which have a boiling point of about 240° C. or higher and possibly of about 250° C. or higher. It is also possible to use materials that can slowly release perfume ingredients after the fabric is treated by the fabric treatment composition 70.

Other perfume ingredients can act as solvents. In some cases this can help facilitate the incorporation of other perfume or oil ingredients into the overall fabric treatment composition 70. A particularly good example is benzyl alcohol. Benzyl alcohol has limited water solubility (clogP of about 1.2) and has been shown to help incorporate other perfume ingredient mixes into these fabric treatment compositions 70.

The fabric treatment composition 70 can comprise a branched hydrocarbon. An effective amount of a hydrocarbon with sufficient branching can be used which provides a stable, possibly well dispersed, possibly translucent, and even a clear, highly aqueous microemulsion wrinkle reduction composition. The hydrocarbon component may be saturated or unsaturated and possibly have a carbon content and structure so as to be a liquid at room temperature as opposed to being volatile or a solid.

One non-limiting example of a suitable branched hydrocarbon is ISOPAR V available from ExxonMobile Incorporated of Irving, Tex. Another suitable branched hydrocarbon is PERMETHYL 102A available through Presperse Incorporated of Somerset, N.J.

The branched hydrocarbons can be used at an appropriate level to make a possibly clear, stable microemulsion mixture in conjunction with the water soluble quaternary surfactant and perfume components. The branched hydrocarbon may be incorporated into the refresher spray separate from or pre-mixed in conjunction with perfume components.

Other optional, but possibly desirable ingredients which may optionally be used in the fabric treatment composition 70 include nonionic surfactants, buffering agents, odor control agents, perfume microcapsules, cyclodextrin, low molecular weight polyols, metal salts, antibacterial and preservative agents, pH adjustment agents, as well as other optional ingredients:

The fabric treatment composition 70 can comprise a nonionic surfactant. Examples of optional, but suitable nonionic surfactants are SURFYNOL 465, SURFYNOL 104 (2,4,7,9-tetramethyl-5-decyne-4,7-diol), and mixtures of the two. A suitable mixture is 3:1 SURFYNOL 465 to SURFYNOL 104. The SURFYNOL surfactants are available from Air Products and Chemicals, Incorporated of Allentown, Pa.

The nonionic can be selected from the group consisting of alkyl EO's & alkyl EO-PO's, APE'S, EO-PO block polymeric surfactants, EO-PO amine polymeric surfactants, alcohols and branched alcohols, APG's, glucose amides, MEE's, silicone surfactants, and combinations thereof.

The fabric treatment composition 70 can comprise nonionic and anionic surfactants. Anionic surfactants are well-known to those skilled in the art. Examples include alkylbenzene sulphonates, particularly linear alkylbenzene sulphonates having an alkyl chain length of C8-C I 5; primary and secondary alkylsulphates, particularly C8-C15 primary alkyl sulphates; alkyl ether sulphates; olefin sulphonates; alkyl xylene sulphonates: dialkyl sulphosuccinates; and fatty acid ester sulphonates. Sodium salts are generally suitable.

The nonionic surfactant can be sulfates and sulfonated anionics. The nonionic surfactant can be selected from the group consisting of LAS, AS, AES, MES, AEC, SAS's with C8-C20 alkyl, aryl or alkylaryl linear or branched hydrophobes, and combinations thereof.

Nonionic surfactants that may be used in the fabric treatment composition 70 include the primary and secondary alcohol ethoxylates, especially the CS—C20 aliphatic alcohols ethoxylated with an average of from 1 to 20 moles of ethylene oxide per mole of alcohol, and more especially the C10-C15 primary and secondary aliphatic alcohols ethoxylated with an average of from 1 to IO moles of ethylene oxide per mole of alcohol. Non-ethoxylated nonionic surfactants include alkylpolyglycosides, glycerol rnonoethers, and polyhydroxyarnides (glucamide).

The fabric treatment composition 70 can comprise a cationic surfactant. Cationic surfactants that may be used in the fabric treatment composition 70 include quaternary ammonium salts of the general formula R 1 R 2 R3 R4 N+X— wherein the R groups are independently hydrocarbyl chains of CI—C22 length, typically alkyl, hydroxyalkyl or ethoxylated alkyl groups, and X is a solubilising cation (for example, compounds in which R1 is a CS—C22 alkyl group, preferably a CS—C10 or CI2-C14 alkyl group, R2 is a methyl group, and R3 and R4, which may be the same or different, are methyl or hydroxyethyl groups); and cationic esters (for example, choline esters) and pyridinium salts.

The cationic surfactant can be selected from the group consisting of tetraalkylammonium salts, alkoxylated alkyl ammonium salts, alkyl pyridinium salts, pH-dependent primary, secondary or tertiary alkyl amines, and combinations thereof.

Another suitable nonionic class of surfactants are alkly polyglycoside surfactants. Examples of these surfactants are GLUCOPON 215, PLANTAREN 2000 N UP and GLUCOPON 425 and the like. These surfactants are available thru Cognis Oleochemicals of Selangor, Malaysia. These surfactants are particularly useful when the fabric treatment composition 70 pH is targeted away from neutral (pH 7) as they are stable across a broad range of pH's.

Another nonionic surfactant group that can be used when the product pH is at or near 7, are the SILWET silicone polyethers. Nonlimiting examples of these silicone polyethers are the SILWET® materials which are available from GE Silicones. Representative SILWET® silicone polyethers which contain only ethyleneoxy ($C_2H_40$) groups are as follows:

| Name | Average Molecular Weight ("MW") in Daltons |
|---|---|
| L-7608 | 600 |
| L-7607 | 1,000 |
| L-77 | 600 |
| L-7605 | 6,000 |
| L-7604 | 4,000 |
| L-7600 | 4,000 |
| L-7657 | 5,000 |
| L-7602 | 3,000 |
| L-7622 | 10,000 |
| L-8600 | 2,100 |
| L-8610 | 1,700 |
| L-862 | 2,000 |

Nonlimiting examples of SILWET® silicone polyethers which contain both ethyleneoxy ($C_2H_40$) and propyleneoxy ($C_3H60$) groups are as follows:

| Name | Average MW in Daltons | EO/PO ratio |
|---|---|---|
| L-720 | 12,000 | 50/50 |
| L-7001 | 20,000 | 40/60 |
| L-7002 | 8,000 | 50/50 |
| L-7210 | 13,000 | 20/80 |
| L-7200 | 19,000 | 75/25 |
| L-7220 | 17,000 | 20/80 |

Nonlimiting examples of SILWET® silicone polyethers which contain only propyleneoxy (C3H60) groups are as follows:

| Name | Average MW in Daltons |
|---|---|
| 1,7500 | 3,000 |
| 1,7510 | 13,000 |
| 1,7550 | 300 |
| 1,8500 | 2,800 |

Suitable SILWETS® aid in color restoration when included in the fabric treatment composition 70 in a sufficient concentration and can also provide softness, which is especially suitable when a silicone polymer leaves a rough feeling on the surface of the fabric. Nonlimiting examples of suitable SILWETS® include L77, L7001, L7200, L7087 and, particularly, L-7600. Some non-limiting suitable Dow Corning® silicone polyethers include Dow Corning® DC Q2-5247, (dimethyl, methylhydroxypropyl, ethoxylated propoxylated siloxane, primarily [CAS#68937-55-3] comprised of siloxane, EO, and PO. Other non-limiting examples of siliconepolyethers that can be useful in the present invention include the following compounds available from Dow Corning®: 193, 112, 8600, FF-400 Fluid, Q2-5220, Q4-3667, PP 5495, as well as compounds available from Toray Dow Corning Silicone Co., Ltd. known as SH3771C, SH3772C, SH3773C, SH3746, SH3748, SH3749, SH8400, SF8410, and SH8700, KF351 (A), KF352 (A), KF354 (A), and KF615 (A) of Shin-Etsu Chemical Co., Ltd., TSF4440, TSF4445, TSF4446, TSF4452 of Toshiba Silicone Company. Another non-limiting example is SLM 21200 from Wacker of Germany.

Some silicone polyethers (especially the more hydrophobic versions) may require additional emulsifying agents to make a stable spray fabric treatment composition 70. Such emulsifying agents are typically anionic, nonionic, cationic, amphoteric, or zwitterionic surfactants or mixtures thereof. Typically emulsifying agents and surfactants can also act as spreading agents on the fabric to spread out active ingredients such as the silicone polymers. Typically, the minimum levels of the nonionic surfactant are at least about 0.01%, suitably at least about 0.05%, more suitably at least about 0.1% while typical maximum levels of nonionic surfactant can be up to about 5%, suitably less than about 3% and more suitably less than about 1.5%.

The fabric treatment composition 70 can comprise amphoterics, zwitterionics, and semi-polar surfactants. The fabric treatment composition 70 can comprise one or more of amine oxide, betaines, and sultaines.

The fabric treatment composition 70 can comprise a buffering agent. Buffering agents may be incorporated into the fabric treatment composition 70 to help control the pH of the product during making and in use. If the product is formulated at an alkaline pH, and sprayed during use, a buffer in the alkaline pH range can help prevent pH drop as a result of mixing with carbon dioxide from the air during spraying. Holding the pH at a targeted value can also help with neutralizing soils or malodors on fabric. Any suitable buffer, organic or inorganic, for the desired product pH can be used, providing at the level used it affords the mixture adequate stability. Suitable alkaline buffers include, but are not limited to, triethanolamine, glycine, arginine, carbonate salts, bicarbonate salts such as sodium bicarbonate, and the like.

The fabric treatment composition 70 can comprise an odor control agent. Optionally, an effective amount of malodor control agents may be used if desired to provide additional malodor capturing/sequestering effects.

The fabric treatment composition 70 can comprise perfume microcapsules.

The fabric treatment composition 70 can comprise cyclodextrin. As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics.

As the water is being removed however, e.g., the fabric is being dried off, some low molecular weight organic amines and acids have more affinity and will complex with the cyclodextrins more readily.

The cavities within the cyclodextrin in the fabric treatment compositions 70 described herein can remain essentially unfilled (the cyclodextrin remains uncomplexed) while in solution, to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature.

Beta-cyclodextrin is not preferred in fabric treatment compositions 70 which call for a level of cyclodextrin higher than its water solubility limit. Non-derivatised beta-cyclodextrin is generally not suitable when the fabric treatment composition 70 contains surfactant since it affects the surface activity of most of the suitable surfactants that are compatible with the derivatised cyclodextrins.

For controlling odor on fabrics, the fabric treatment composition 70 can be applied to the fabric as a spray. It is suitable that the fabric treatment compositions 70 of the present invention contain low levels of cyclodextrin so that a visible stain does not appear on the fabric at normal usage levels. Suitably, the solution used to treat the surface under usage conditions is virtually not discernible when dry. Typical levels of cyclodextrin in fabric treatment compositions 70 for usage conditions are from about 0.01% to about 5%, suitably from about 0.1% to about 4%, more suitably from about 0.5% to about 2% by weight of the fabric treatment composition 70. Fabric treatment compositions 70 having higher concentrations can leave unacceptable visible stains on fabrics as the solution evaporates off of the fabric. This is especially a problem on thin, colored, synthetic fabrics, to avoid or minimize the occurrence of fabric staining, it is suitable that the fabric be treated at a level of less than about 5 mg of cyclodextrin per gram of fabric, more suitably less than about 2 mg of cyclodextrin per gram of fabric. The presence of the surfactant can improve appearance by minimizing localized spotting.

The fabric treatment composition 70 can comprise low molecular weight polyols. Low molecular weight polyols with relatively high boiling points, as compared to water, such as ethylene glycol, propylene glycol, and/or glycerol are suitable optional ingredients for improving odor control performance of the fabric treatment composition 70 when cyclodextrin is present. Not to be bound by theory, it is believed that the incorporation of a small amount of low molecular weight glycols into the fabric treatment composition 70 enhances the formation of the cyclodextrin inclusion complexes as the fabric dries.

It is believed that the polyols' ability to remain on the fabric for a longer period of time than water, as the fabric dries allows it to form ternary complexes with the cyclodextrin and some malodorous molecules. The addition of the glycols is believed to fill up void space in the cyclodextrin cavity that is unable to be filled by some malodor molecules of relatively smaller sizes. The glycol used can be glycerin, ethylene glycol, propylene glycol, diethylene glycol, dipropylene glycol or mixtures thereof, alternatively ethylene glycol and/or propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the fabric treatment composition 70 of the present invention.

Glycol can be added to the fabric treatment composition 70 of the present invention at a level of from about 0.01% to about 3%, by weight of the fabric treatment composition 70, suitably from about 0.05% to about 1%, more suitably from about 0.1% to about 0.5%, by weight of the fabric treatment composition 70. The weight ratio of low molecular weight polyol to cyclodextrin can be from about 2:1,000 to about 20:100, also suitably from about 3:1,000 to about 15:100, also suitably from about 5:1,000 to about 10:100, and also suitably from about 1:100 to about 7:100.

The fabric treatment composition 70 can comprise a metal salt. The fabric treatment composition 70 can include metallic salts for added odor absorption and/or antimicrobial benefit for the cyclodextrin solution when cyclodextrin is present. The metallic salts can be selected from the group consisting of copper salts, zinc salts, and mixtures thereof.

Metallic salts can be added to the fabric treatment composition 70 at a level of from about 0.05% to about 5%, alternatively from about 0.1% to about 3%, alternatively from about 0.2% to about 2% by weight of the fabric treatment composition 70. When zinc salts are used as the metallic salt, and a clear solution is desired, it may be helpful to adjust the pH of the solution to less than about 7 in order to keep the solution clear.

When any of the odor control agents are added to the fabric treatment compositions 70 of the present invention, they can be present at a level of from about 0.01% to about 5%; alternatively from about 0.1% to about 3%, and alternatively from about 0.2% to about 2% by weight of the fabric treatment composition 70.

The fabric treatment composition 70 can comprise antibacterial and/or preservative agents. The fabric treatment composition 70 of the present invention can comprise an effective amount of antimicrobial active, to kill, or reduce the growth of microbes, wherein the amount of antimicrobial active when used is suitably from about 0.001% to about 0.5%, alternatively from about 0.002% to about 0.2%, alternatively from about 0.005% to about 0.1%, by weight of the fabric treatment composition 70. The effective antimicrobial active can function as disinfectants/sanitizers, and is useful in providing protection against organisms that become attached to the fabrics.

Examples of additional preservatives include the hydantoin chemistry based materials. Suitable examples of hydantoin chemistry based materials include the dimethylol-5,5-dimethylhydantoin (DMDMH) based preservatives as exemplified by Dantogard 2000 and Dantogard Plus available from Lonza Group Ltd. of Basel, Switzerland.

Other non-limiting examples of suitable preservatives that could be used alone or in combination are 2-Methyl-4-isothiazolin-3-one and 2-Methyl-3(2H) isothiazolin exemplified by NEOLONE M-10 products as supplied by Rohm & Haas; 1,2 Benzisothiazolin 3-one based materials exemplified by KORALONE B-119 by Rohm & Haas; mixtures of Methylisothiazolinone and Benzisothiazolinone compounds exemplified by ACTICIDE MBS by Thor/Actichem; mixtures of Methylchloroisothiazolinone and Methylisothiazolinone as exemplified by KATHON GC supplied by Rohm & Haas; and 1,2-Benzisothiazolin-3-one exemplified by Proxel GXL as supplied by Arch Chemicals.

The fabric treatment composition 70 can comprise a pH adjustment agent. For lowering the fabric treatment composition 70 pH to a desired level, acidic materials can be utilized. Non-limiting examples of suitable acids are small organic acids, like citric acid and inorganic acids like sulfuric or hydrochloric acid. The acid used, and final pH of the fabric treatment composition 70, can be chosen to give a stable mix both chemically and physically.

For raising the fabric treatment composition 70 pH to a desired level, basic materials can be utilized. Non-limiting examples of suitable bases are typically low molecular weight inorganic bases like sodium hydroxide. The base used, and final pH of the fabric treatment composition 70, can be chosen to give a stable mix both chemically and physically. Suitably the fabric treatment compositions 70 of the present invention have a pH of from about 3 to about 11, alternatively from about 4 to about 10, and alternatively from about 5 to about 9.

The fabric treatment composition 70 can optionally comprise adjunct odor-controlling materials, chelating agents, antistatic agents, softening agents, insect and moth repelling agents, colorants, antioxidants, chelants, bodying agents, drape and form control agents, smoothness agents, wrinkle control agents, sanitization agents, disinfecting agents, germ control agents, mold control agents, mildew control agents, antiviral agents, drying agents, stain resistance agents, soil release agents, malodor control agents, fabric refreshing agents and freshness extending agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, anti-pilling agents, defoamers and anti-foaming agents, UV protection agents for fabrics and skin, sun fade inhibitors, anti-allergenic agents, enzymes, water proofing agents, fabric comfort agents, shrinkage resistance agents, stretch resistance agents, stretch recovery agents, functional microcapsules containing active materials such as perfumes, silicones, skin care agents, glycerin, and natural actives such as aloe vera, vitamin E, rhea butter and the like, and mixtures thereof in addition to the silicone molecules. The total level of optional ingredients can be low, suitably less than about 5%, alternatively less than about 3%, and alternatively less than about 2%, by weight of the fabric treatment composition 70. These optional ingredients exclude the other ingredients specifically mentioned hereinbefore. Incorporating adjunct odor-controlling materials can enhance the capacity of the cyclodextrin to control odors as well as broaden the range of odor types and molecule sizes which can be controlled. Such materials include, for example, metallic salts, water-soluble cationic and anionic polymers, zeolites, water-soluble bicarbonate salts, and mixtures thereof.

The carrier for the fabric treatment composition 70 can be water. The water can be distilled, deionized, or tap water.

Water can be useful for fabric wrinkle removal or reduction. Not wishing to be bound by theory, it is believed that water breaks many intrafiber and interfiber hydrogen bonds that keep the fabric in a wrinkled state. It can also swell, lubricate and relax the fibers to help the wrinkle removal process.

Water can also serves as the liquid carrier for the cyclodextrins, and can facilitate the complexation reaction between the cyclodextrin molecules and any malodorous molecules that are on the fabric when it is treated. The dilute aqueous solution can also provide the maximum separation of cyclodextrin molecules on the fabric and thereby maximizes the chance that an odor molecule will interact with a cyclodextrin molecule. Further, water can have an unexpected odor controlling effect of its own. It has been discovered that the intensity of the odor generated by some polar, low molecular weight organic amines, acids, and mercaptans is reduced when the odor-contaminated fabrics are treated with an aqueous solution. Not to be bound by theory, it is believed that water solubilizes and depresses the vapor pressure of these polar, low molecular weight organic molecules, thus reducing their odor intensity.

The level of liquid carrier in the fabric treatment composition 70 can be at least about 80%, suitably greater than about 90%, alternatively greater than about 95%, by weight of the fabric treatment composition 70.

Optionally, in addition to water, the carrier can contain a low molecular weight organic solvent that is substantially soluble in water. Non-limiting examples are ethanol, n-propanol, isopropanol, n-butanol, tert-butyl alcohol deodorized acetone, acetone, and the like, and mixtures thereof. Low molecular weight alcohols can help the treated fabric to dry faster. Other solvents can also be used such as ethers of ethylene glycol and propylene glycol (e.g., ethylene glycol monohexyl ether) and glycols such as glycerin, propylene glycol, dipropylene glycol, ethylene glycol, and the like. Other non-limiting examples include 1,3-propanediol, diethylene glycol, 1,2,3-propanetriol, propylene carbonate, phenylethyl alcohol, 2-methyl 1,3-propanediol, hexylene glycol, sorbitol, polyethylene glycols, 1,2-hexanediol, 1,2-pentanediol, 1,2-butanediol, 1,4 butanediol, 1,4-cyclohexanedimethanol, pinacol, 1,5-hexanediol, 1,6-hexanediol, 2,4-dimethyl-2,4-pentanediol, 2,2,4-trimethyl-1,3-pentanediol (and ethoxylates), 2-ethyl-1,3-hexanediol, phenoxyethanol (and ethoxylates), other glycol ethers such as butyl carbitol and dipropylene glycol n-butyl ether, ester solvents such as dimethyl esters of adipic, glutaric, and succinic acids, and mixtures thereof. The optional solvent is also useful in the solubilization of some shape retention polymers and some silicone polymers described hereinbefore. The optional water soluble low molecular weight solvent can be used at a level of up to about 8%, typically from about 0.05% to about 8%, alternatively from about 0.1% to about 5%, alternatively from about 0.2% to about 3%, by weight of the total fabric treatment composition 70. Factors that need to be considered when a high level of solvent is used in the fabric treatment composition 70 are cost, odor, flammability, and environmental impact.

The fabric treatment composition 70 can be free from an emulsifier. The fabric treatment composition 70 can be free from one or more or all of the following: mono- and diglycerides and esters thereof, ethoxylated mono- and diglycerides, glyceryl esters, polyglyceryl esters, fatty carboxylates, sorbitan esters and polysorbates, fatty acid esters based on glycols and sugars, and lecithins.

The fabric treatment composition 70 can comprise from about 0.01% to about 1% by weight cationic surfactant, about 0.01% to about 1% by weight of a wetting agent, about 0.1% to about 1% by weight of a buffer, about 0.001% to about 1% of a biocide, and between about 0.001% to about 1% by weight of a pH adjuster. The fabric treatment composition 70 can comprise between about 0.001% and about 1% by weight perfume. The balance of the formula can be water. The wetting agent can be one or both of, by way of non-limiting example, ethoxylated 2,4,7,9-tetramethyl 5 decyn-4,7-dio (e.g. 0.01% to about 1% by weight of the fabric treatment composition 70) and 2,4,7,9-tetramethyl-5-decyne-4,7-diol (e.g. 0.01% to about 1% by weight of the fabric treatment composition 70. The buffer can be triethanolamine and can be at a level of about 0.30% by weight. The lubricant can be isoeicosane and can be at a level of about 0.20%. The biocide can be 1,2 benzisothiazolin-3-one (BIT) and can be at a level of 0.0085%. The pH adjuster can be hydrochloric acid. The cationic surfactant can be octadecyl,2-methylhexyl, dimethyl ammonium methylsulfate. The fabric treatment composition 70 can comprise SURFYNOL 465 and Surfynol 104. The fabric treatment composition 70 can comprise SURFYNOL 465 and Surfynol 104 in a 3:1 ratio by mass of SURFYNOL 465 to SURFYNOL 104. The fabric treatment composition 70 can comprise 2,4,7,9-tetramethyl-5-decyne-4,7,diol (10 EO's) and 2,4,7,9-tetramethyl-5-decyne,4,7,diol (with no EO's). The fabric treatment composition 70 can comprise 2,4,7,9-tetramethyl-5-decyne-4,7,diol (10 EO's) and 2,4,7,9-tetramethyl-5-decyne,4,7,diol (with no EO's) in a 3:1 ratio by mass of 2,4,7,9-tetramethyl-5-decyne-4,7,diol (10 EO's) to 2,4,7,9-tetramethyl-5-decyne,4,7,diol (with no EO's).

The fabric treatment composition 70 can be an aqueous composition. The fabric treatment composition 70 can be an aqueous composition comprising one or more of, or all of, anionic surfactant, cationic surfactant, nonionic surfactant, amphoteric surfactant, and perfume.

The container 5 disclosed herein can be used in a method treating a fabric comprising the steps of inserting the container 5 disclosed herein into a port 108 of a fabric refreshing device 101. The method can further comprise the step of preparing the fabric refreshing device 101 for operation. The method can further comprise the step of activating operation of the fabric refreshing device 101. The method can further comprise the step of dispensing the fabric treatment composition 70 from the container 5 onto a fabric contained in the fabric treatment device 101.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container for a fabric treatment composition comprising:

a main body comprising:

a container floor including a central raised portion extending upwardly within said container, and a collection zone disposed around the central raised portion, at least a portion of the collection zone being located on a longitudinal axis of said container and at least a portion of the central raised portion intersecting the longitudinal axis and a transverse axis of said container, wherein the central raised portion is S shaped or reverse S shaped;

a plurality of planar peripheral walls extending from the container floor;

a hydrophobic substrate disposed on at least one of the container floor and the plurality of planar peripheral walls;

a planar peripheral flange extending about an outer perimeter of the plurality of planar peripheral walls; and an adhesive disposed on the planar peripheral flange; and a needle piercable membrane operably coupled to the planar peripheral flange via the adhesive to define an interior volume of less than 80 mL within the container and that contains said fabric treatment composition, the needle piercable membrane configured to be pierced by a cannula of a fabric refreshing cabinet device.

2. The container according to claim 1, wherein the planar peripheral flange is free of a peripheral lip.

3. The container according to claim 1, wherein the container floor, the central raised portion, the plurality of planar peripheral walls, and the planar peripheral flange comprise a thermoset polymer.

4. The container according to claim 1, wherein the container floor, the central raised portion, the plurality of planar peripheral walls, and the planar peripheral flange comprise a thermoplastic polymer.

5. The container according to claim 1, wherein the container floor, the central raised portion, and the plurality of planar peripheral walls comprise a hydrophobic substrate.

6. The container according to claim 1, wherein said fabric treatment composition is provided in a volume such that there is at least about 2 mm of head space between the needle piercable membrane and said fabric treatment composition.

7. The container according to claim 1, wherein the needle piercable membrane comprises a material selected from a group consisting of metallic foil, polymer film, and combinations thereof.

8. The container according to claim 1, wherein when said container is resting on a flat surface with the container floor oriented towards the flat surface, the planar peripheral flange is parallel to the flat surface.

9. The container according to claim 1, wherein said fabric treatment composition is provided in a volume of less than about 60 mL.

10. The container according to claim 1, wherein the plurality of planar walls extend upwardly from the container floor at approximately a 45 degree angle.

11. The container according to claim 1, wherein the needle piercable membrane cannot be removed without destroying the needle piercable membrane.

12. The container according to claim 1, wherein said container is comprised of a material selected from a group consisting of polyethylene terephthalate, polypropylene, high impact polystyrene, polyethylene, high density polyethylene, and polyvinyl chloride.

13. A container for a fabric treatment composition comprising:

a main body comprising:

a container floor including a central raised portion extending upwardly within said container, and a collection zone disposed around the central raised portion, at least a portion of the collection zone being located on a longitudinal axis of said container and at least a portion of the central raised portion intersecting the longitudinal axis and a transverse axis of said container;

first and second planar walls extending upwardly from the container floor;

first and second frusto-conical sections extending upwardly from the container floor, wherein the first and second frusto-conical sections are disposed between the first and second planar walls and define an interior volume;

a hydrophobic substrate disposed on at least one of the container floor and the first and second planar walls; and a lipless peripheral flange extending from the first and second planar walls and the first and second frusto-conical sections; and a needle piercable membrane sealed to the lipless peripheral flange to enclose the interior volume, wherein the interior volume contains said fabric treatment composition, wherein the central raised portion defines at least one collection zone from which a cannula of a fabric refreshing cabinet device draws said fabric treatment composition.

14. The container according to claim 13, wherein the first and second planar walls and the first and second frusto-conical sections extend upwardly from the container floor at approximately a 45 degree angle.

15. The container according to claim 13, wherein said fabric treatment composition is provided in a volume such that there is at least about 2 mm of head space between the needle piercable membrane and said fabric treatment composition.

* * * * *